United States Patent [19]

Udomkesmalee et al.

[11] Patent Number: 5,011,155

[45] Date of Patent: Apr. 30, 1991

[54] GOLF PRACTICE DEVICE

[76] Inventors: Suraphol Udomkesmalee; Phaichitr Tiemsanjai, both of 3323 W. 134th St., Hawthorne, Calif. 90250

[21] Appl. No.: 612,930

[22] Filed: Nov. 13, 1990

[51] Int. Cl.[5] ..... A63B 69/36

[52] U.S. Cl. ..... 273/200 A; 273/198; 273/58 C

[58] Field of Search ..... 273/200 R, 200 A, 198, 273/196, 197 R, 197 A, 184 B, 185 C, 58 C

[56] References Cited

U.S. PATENT DOCUMENTS

| | | | |
|---|---|---|---|
| 2,948,532 | 8/1960 | Jepsen | 273/58 C |
| 4,662,639 | 5/1987 | Bonotto | 273/184 B |
| 4,944,513 | 7/1990 | Zentner | 273/26 EA |

*Primary Examiner*—George J. Marlo

[57] ABSTRACT

A carpet base (10,11,12) with a small rope (30) running through a golf ball (20). Two crisscrossing holes (21 and 22) are drilled into the golf ball at an angle. Thus, the rope enters one hole and exits another. Finally, each end of the rope is tied in a knot (31,32) beneath each hole (13,14) at the bottom side of the base.

2 Claims, 1 Drawing Sheet

GOLF PRACTICE DEVICE

BACKGROUND

1. Field of Invention

This invention relates to the sport of golf, specifically to a device that allows one to practice his or her golf swing using a relatively small area.

2. Description of Prior Art

Golfers commonly practice their golf swing at driving ranges, where the effectiveness of each swing is judged by the flight of a golf ball. Thus, a large field (several hundred yards long) is required.

By having a practice device that occupies a relatively small area (5–10 feet long), golfers can enjoy practicing their swing almost anywhere: office, home, backyard, etc. Thus inventors have created several types of practice devices for this purpose.

These prior inventions can be categorized by how the restricted ball movement is defined, as follows:

(a) tethered ball using a rigid cord;

(b) tethered ball using a flexible cord;

(c) translating ball along a guided track.

U.S. Pat. No. 4,861,035 to Page (1988) offers a device employing a tethered ball with a rigid cord. This does not provide the proper feel for the game, since the ball is not allowed to freely translate forward. Furthermore, this type of device usually consists of many components that prohibit the clear view of the ball desired by golfers for focussing on the ball.

In category (b), U.S. Pat. No. 3,830,504 to Koo (1974), there are further complications as using a flexible cord presents the danger of the tether breaking if a large force is applied when striking the ball. To account for this, a simulated practice golf ball which is substantially lighter than a standard golf ball is employed, as proposed in U.S. Pat. No. 4,071,250 to Vroome (1976) and U.S. Pat. No. 4,655,460 to Hambright (1986). The problem of using a lighter practice ball is that one can no longer sense the true feeling of the game because a lighter ball reacts differently upon impact than a standard golf ball. Furthermore, the effectiveness of a golf swing is difficult to determine when a standard golf ball is not employed.

U.S. Pat. No. 2,929,632 to Moffatt (1957) and U.S. Pat. No. 4,932,660 to Wang (1989) disclose practice devices that allow visual determination of a straight, hooked or sliced ball based on the nature of a tethered ball rotating about a horizontal axis.

Our invention falls into category (c), that of translating a golf ball along a guided track. This approach allows one to employ an actual golf ball while eliminating the problem of having an excessive strain on string tension of the above tethering approaches. In addition, our invention differs from previous inventions in this category as follows:

(a) A golf ball is translated along a rope by creating a passage inside the golf ball for the rope to pass through, and not by an external ring connected to the ball as is used, for example in U.S. Pat. No. 3,754,761 to Pruss (1972) and U.S. Pat. No. 4,139,197 to Windall (1978). This approach eliminates the possibility of the ball being dislodged from its external connection after a repeated period of bombardments by a golf club.

(b) The guided rope enters and exits the golf ball at an angle. This allows the backside of the golf ball to be clear of any obstruction and provides optimal contact with a golf club.

Although U.S. Pat. No. 3,558,134 to Hoitsma (1968) discloses the technique of sliding a diametrically apertured ball along a guide wire, our approach of running a rope through an angular passage inside a solid-core ball is systematically different and more suitable for golf practice devices. This is because by angling the placement of the rope, a clear point of contact (i.e. hitting point) becomes available that does not exist in U.S. Pat. No. 3,558,134 to Hoitsma (1968).

OBJECTS AND ADVANTAGES

Accordingly, several objects and advantages of our invention are:

(a) to provide a device for practicing a golf swing that more closely simulates the natural setup and feel of an actual golf game than any previous/existing device without requiring golfers to use a large field;

(b) to provide a device that allows golfers to strike an actual golf ball without worrying about the danger of hitting a stray ball or hitting too hard;

(c) to provide a device that allows golfers to recognize a good swing after hitting an actual golf ball without requiring the ball to freely travel in an open space (a good swing is quickly recognizable if the ball freely travels from one side of device to the other);

(d) to provide a realistic device that allows ease-of-repitition by not requiring golfers to travel over tens or hundreds of yards to retrieve balls.

Further objects and advantages are to provide a device that is portable, convenient to use, and inexpensive.

DRAWING FIGURES

REFERENCE NUMERALS IN DRAWINGS

Figure 1:
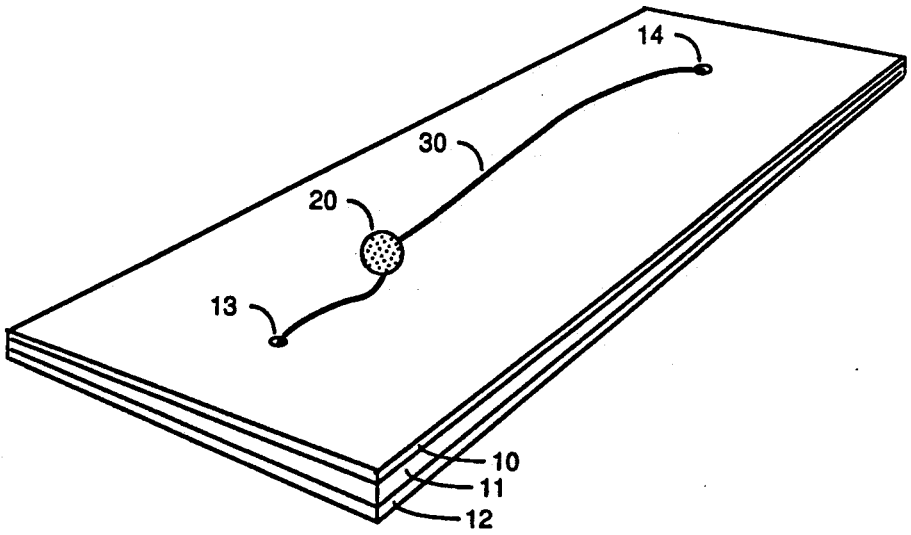
FIG. 1 is a perspective view of our invention.

10 carpet mat
11 foam cushion
12 base
13 through-hole
14 through-hole
20 golf ball
30 rope
31 knot
32 knot

DESCRIPTION OF INVENTION

FIG. 1 shows a perspective view of a basic version of our device. The base of this device has a foam cushion 11 and a thin base 12 under a carpet mat 10. Two small holes 13 and 14 at different ends of the base are drilled through the carpet and the base (FIG. 2).

Figure 3:
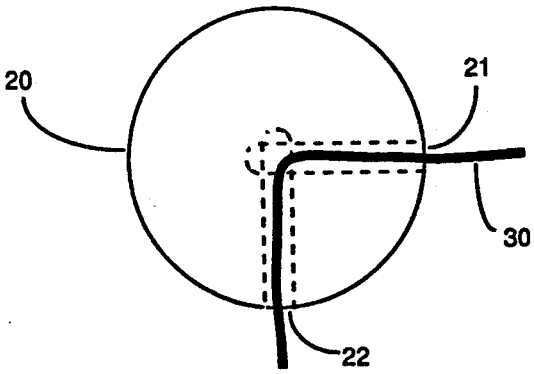
FIG. 3 is a view in detail of a golf ball connection with a rope.

To run a small rope through a golf ball, two holes 21 and 22 (approximately half of the golf ball diameter in length) must be drilled into a golf ball (FIG. 3). Holes 21 and 22 must crisscross, and ball 20 must have a solid core. Although, FIG. 3 shows a 90° angle of crisscrossing, any angle will do. One end of rope 30 is then inserted through hole 21 of the golf ball 20 and pulled out through hole 22. A long and narrow tweezer can be used here to pull out the rope.

Figure 2:
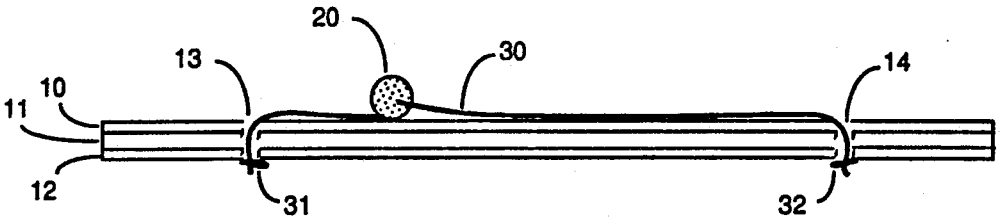
FIG. 2 is a side view of our invention.

To complete the device (after passing the rope through the ball), two ends of rope 30 are inserted through holes 13 and 14 and tied into two big knots 31 and 32 on the bottom side of base 12 (FIG. 2). The rope must be substantially long enough to cover the distance between holes 13 and 14, thickness of carpet 10, cushion 11, and base 12, and knots 31 and 32. Having a slackness in rope 30 is a plus. Also, knots 31 and 32 must be big enough to prevent the rope from being pulled through holes 13 and 14. Large washers with small inside diameters can be used here if holes 13 and 14 are too large or if rope 30 is too small.

OPERATION OF INVENTION

To operate the device, one simply pulls ball 20 to sit on top of hole 13, hits the ball, then either switches side or pulls the ball back along rope 30. The quality of a hit can be judged by how smoothly the ball travels along the rope. An ineffective or undesirable swing would result in excessive waggling of rope 30 and/or stoppage of ball 20 prior to reaching the other end of the rope.

SUMMARY, RAMIFICATION AND SCOPE

Accordingly, the reader will see that this invention can provide a practical, inexpensive and effective setup for practicing one's golf swing. An actual golf ball can be used. The ball can be set properly as in an actual golf game without any obstruction on the backside or on the topside. Only a small area (less than 10 square feet) is required. In addition, a good swing can easily be recognized, and the actual feel and performance of one's natural golf swing will be more closely simulated than has been previously possible.

Although the description above contains some specificities, these should not be construed as limiting the scope of the invention but as merely providing illustrations of some of the presently preferred embodiments of this invention. For example, a different ball other than an actual golf ball can be used; the length between the two carpet holes and the rope can vary; the size of the base can vary; a rubber tee may be added to any of the two holes in the carpet base; different types of materials and colors for carpet, cushion, and base can be used; the crisscrossing holes in the golf ball can be drilled at any angle and depth; mechanisms for ball retrieval between holes can be added, etc.

Thus, the scope of the invention should be determined by the appended claims and their legal equivalents, rather than by the example given.

I claim:

1. A golf practice device comprising a golf ball having an opening passing therethrough, a flexible cord passing through said opening and having first and second ends, means for anchoring each of said ends to substantially spaced apart locations on a base member from which said golf ball may be driven with a golf club, and said opening through said ball defining a continuous pathway which is not straight throughout its entire length whereby said golf ball may be placed upon said base member with the opposite ends of said cord anchored to said base member, and a clear point of contact on said golf ball is available for an impact with the striking face of a golf club which causes said ball to travel along said cord.

2. A golf practice device as defined in claim 1 wherein said opening through said ball defines a pathway having first and second intersecting portions which are generally perpendicular to each other.

* * * * *